US011584576B2

(12) United States Patent
Glinert

(10) Patent No.: US 11,584,576 B2
(45) Date of Patent: Feb. 21, 2023

(54) INTEGRATED CARD AND GIFT PACKAGING WITH CARRIER

(71) Applicant: Multi Packaging Solutions, Inc., Lansing, MI (US)

(72) Inventor: Kenneth Glinert, Chappaqua, NY (US)

(73) Assignee: Multi Packaging Solutions, Inc., Lansing, MI (US)

( * ) Notice: Subject to any disclaimer, the term of this patent is extended or adjusted under 35 U.S.C. 154(b) by 0 days.

(21) Appl. No.: 17/316,809

(22) Filed: May 11, 2021

(65) Prior Publication Data

US 2022/0363463 A1 Nov. 17, 2022

(51) Int. Cl.

| | |
|---|---|
| ***B65D 75/20*** | (2006.01) |
| ***B65D 75/56*** | (2006.01) |
| ***B65D 75/52*** | (2006.01) |
| ***B65D 75/58*** | (2006.01) |

(52) U.S. Cl.

CPC ..... *B65D 75/20* (2013.01); *B65D 75/522* (2013.01); *B65D 75/566* (2013.01); *B65D 75/5805* (2013.01)

(58) Field of Classification Search

CPC .... B42D 15/04; B42D 15/042; B42D 15/045; B65D 75/20; B65D 75/52; B65D 75/522; B65D 75/56; B65D 75/566; B65D 75/58; B65D 75/5805; G06K 7/00; G06K 19/06; G09F 1/06

USPC ..... 206/232, 461, 775; 235/380, 486, 487

See application file for complete search history.

(56) References Cited

U.S. PATENT DOCUMENTS

| | | | | |
|---|---|---|---|---|
| 7,374,095 | B2 | 5/2008 | Blank et al. | |
| 8,256,682 | B2 * | 9/2012 | Chakiris | B42D 15/045 235/380 |
| 8,875,886 | B2 | 11/2014 | Brill et al. | |
| 8,925,823 | B2 * | 1/2015 | Chakiris | B42D 15/045 235/487 |
| 8,931,639 | B2 * | 1/2015 | Payne | B65D 75/20 206/232 |
| 8,960,433 | B2 * | 2/2015 | Smith | B65D 73/0078 206/461 |
| 9,016,469 | B2 | 4/2015 | Roberts | |
| 9,636,939 | B1 | 5/2017 | Ramirez | |
| 9,907,374 | B2 | 3/2018 | Canaday et al. | |
| 2002/0100797 | A1 | 8/2002 | Hollingsworth et al. | |
| 2003/0150142 | A1 | 8/2003 | Street | |
| 2006/0048422 | A1 | 3/2006 | Dyvig et al. | |
| 2008/0128302 | A1 | 6/2008 | Bohlke et al. | |
| 2018/0222241 | A1 * | 8/2018 | Moriarty | B65D 73/0085 |
| 2021/0078782 | A1 * | 3/2021 | Gerrard | B42D 15/045 |

* cited by examiner

*Primary Examiner* — Bryon P Gehman

(74) *Attorney, Agent, or Firm* — Rohini K. Garg

(57) ABSTRACT

Packaging for a transaction card, comprising: (1) a card carrier having the transaction card secured to a first surface of the card carrier; and (2) gift packaging integrally formed with and separable from the card carrier, the gift packaging having a first panel and an opposing second panel; wherein, in a closed state, the gift packaging is folded onto the card carrier so that the second panel of the gift packaging substantially abuts the first surface of the card carrier and sandwiches the transaction card between the first surface of the card carrier and the second panel of the gift packaging.

18 Claims, 3 Drawing Sheets

INTEGRATED CARD AND GIFT PACKAGING WITH CARRIER

FIELD

The present teachings generally relate to transaction cards, and more particularly, to a carrier for transaction cards that includes integrated gift packaging.

BACKGROUND

Various industries utilize monetary transaction cards, such as prepaid cards, gift cards, or other monetized cards. These transaction cards are frequently attached to a card carrier which enables a retailer to display the transaction cards in an ordered manner. The carriers may often include an opening to hang the transaction cards attached to the carriers on a display rack for customers to select for purchase. Similarly, the carriers may include one or more notches for scanning a portion of the transaction cards (e.g., a barcode) to activate the cards, load a desired dollar amount onto the cards, or both.

Transaction cards have become a very popular item to purchase as a gift. As a result, customers may often purchase the transaction (e.g., gift) cards for another person to use when purchasing items in a desired store or retail establishment. When presenting the transaction cards as a gift, a person may often want to utilize packaging or wrapping other than the card carrier retaining the transaction card.

Such other packaging or wrapping may include a gift box, a greeting card, a gift envelope, giftwrap, or a combination thereof. However, to repackage the transaction card, a person may need to remove the transaction card from the card carrier and place the transaction card in a gift box, a greeting card, a gift envelope, of a combination thereof. Similarly, a person may be required to remove the transaction card from the card carrier and package the transaction card in giftwrap. As a result, those seeking to give a transaction card as a gift may be required to purchase additional packaging items and/or may be inconvenienced by the time and labor necessary to repackage the transaction card.

To improve on the conventional card carrier design, some transaction cards may be sold in packages which are prepared for gifting. However, such packages may be formed to already encase and secure a transaction card within the packaging. Therefore, the packaging may make it difficult for a buyer to clearly see what he or she is purchasing, as the transaction cards may be obscured within the packaging or may otherwise be difficult to see. Similarly, a retail merchant may also have difficulty determining what type of transaction card is being purchased, may be unable to properly scan a portion of the transaction card for activation due to the packaging, or both.

Therefore, there remains a need for improved transaction card packaging. What is needed is transaction card packaging having integrated gift packaging. Additionally, there remains a need for transaction card packaging that includes gift packaging, yet still allows a customer, a retail merchant, or both to easily view the transaction card. Thus, what is needed is transaction card packaging that contains the transaction card securely, yet allows for a customer, a retail merchant, or both to open the transaction card packaging without damaging the gift packaging. Moreover, there remains a need for transaction card and gift packaging that allows for display on conventional display racks. Thus, what is needed is transaction card packing that allows for separation of gift packaging from the transaction card packaging after purchase.

SUMMARY

The present teachings meet one or more of the present needs by providing packaging for a transaction card, comprising: (1) a card carrier having the transaction card secured to a first surface of the card carrier; and (2) gift packaging integrally formed with and separable from the card carrier, the gift packaging having a first panel and an opposing second panel; wherein, in a closed state, the gift packaging is folded onto the card carrier so that the second panel of the gift packaging substantially abuts the first surface of the card carrier and sandwiches the transaction card between the first surface of the card carrier and the second panel of the gift packaging.

A long edge of the card carrier and a long edge of the gift packaging may be integrally connected to form a fold line. The fold line may include a first perforation extending along an entire length of the fold line, an entire length of the long edge of the carrier, and an entire length of the long edge of the gift packaging. The tab and the card carrier may each include an aperture, and the apertures of the tab and the card carrier may substantially align when the packaging is in the closed state.

The packaging may further comprise a tab integrally formed and separable from the gift packaging, the card carrier, or both. The tab may be connected to the card carrier by the first perforation. The tab may be connected to the gift packaging by a second perforation extending along a short edge of the gift packaging. The second perforation may extend substantially perpendicular to the first perforation.

In the closed state, the first panel of the gift packaging may be visible from a front view and the card carrier may be substantially obstructed from view. In the closed state, an opposing second surface of the card carrier may be visible from a rear view while the gift packaging may be obstructed from view.

The gift packaging may be an envelope formed by joining the first panel and the opposing second panel. The first panel may be joined to the second panel by an adhesive, and a pocket free of the adhesive may be formed between the first panel and the second panel. The adhesive may form a shape of the pocket to receive the transaction card. The pocket may include an opening along the short edge of the gift packaging located along the second perforation. The pocket may further include a notch along the opening located on the first panel, the second panel, or both panels of the gift packaging. Additionally, the envelope may be dimensionally oversized relative to the transaction card. Moreover, the envelope may include one or more decorative images located on the first panel, the opposing second panel, or both.

The second surface of the card carrier may include a barcode and a window extending through a thickness of the card carrier. A barcode located on the transaction card may be visible through the window of the card carrier. When the transaction card is inserted into the pocket, the transaction card may abut the adhesive, and an edge of the transaction card may be substantially flush with the short edge of the packaging.

Additionally, the present teachings meet the present needs by providing: improved transaction card packaging; transaction card packaging having integrated gift packaging; transaction card packaging that includes gift packaging, yet still allows a customer, a retail merchant, or both to easily view the transaction card; transaction card packaging that contains the transaction card securely, yet allows for a customer, a retail merchant, or both to open the transaction card packaging without damaging the gift packaging; transaction card and gift packaging that allows for display on conventional display racks; and transaction card packing that allows for separation of gift packaging from the transaction card packaging after purchase.

DETAILED DESCRIPTION

Figure 1:
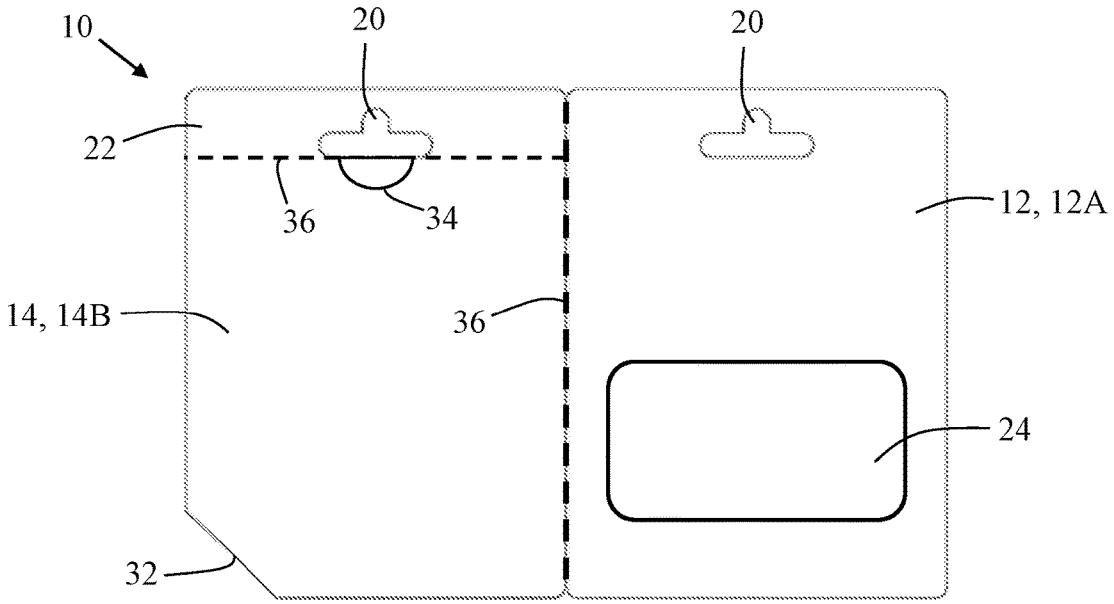
FIG. 1 is a perspective view of packaging for a transaction card in an open position.

The explanations and illustrations presented herein are intended to acquaint others skilled in the art with the invention, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings generally relate to packaging for a transaction card. The packaging may function to securely house one or more items. The packaging may function to prevent tampering with the one or more items prior to a right owner opening the packaging. Additionally, the packaging may function as a display for the one or more items in a retail establishment. The packaging may include one or more layers. For example, the packaging may include two or more layers, three or more layer, or four or more layers. The packaging may include six or less layers, five or less layers, or four or less layers. Alternatively, the packaging may be a single layer.

The packaging may include one or more tamper resistant features, one or more tamper prevention features, or both. For example, the packaging may include cut-resistant material so that a fraudulent individual is unable to discretely cut into the packaging without damaging the packaging, one or more items located within and/or on the packaging, or both. The packaging may be substantially monolithically formed (i.e., the packaging is integrally formed from a single piece of material, such as by integrally forming a carrier and gift packaging). The packaging may be shaped to meet the needs of any desired industry. For example, the packaging may be shaped to have an inner pocket substantially the size of a prepaid card to minimize wasted material.

As described herein, it is envisioned that the packaging may facilitate both display and/or purchasing of one or more items located within the packaging while also providing a customer gift packaging means. Such gift packaging may be integrally formed with, or incorporated into, the packaging so that a customer is not required to purchase additional gift packaging. Therefore, the packaging may decrease a cost incurred by a customer purchasing the one or items within the packaging with the intention of gifting the one or more items.

The one or more items may be a transaction card such as a prepaid card, gift card, other loadable and/or scannable item, or a combination thereof. Alternatively, while transaction cards are discussed in further detail herein with respect to the packaging, the one or more items may also be an item other than a transaction card. For example, the one or more items may be a membership card, voucher card, advertisement, jewelry, electronic device, or a combination thereof. As such, it may be gleaned from the present teachings that the packaging may secure any type of item. Thus, the packaging may also be highly customizable to properly package various sizes and/or shapes of the one or more items. As a result, the packaging may also vary dimensionally.

The packaging may include a card carrier. The carrier may function to at least partially house, at least partially secure, or both the one or more items. The carrier may function to prevent tampering with the one or more items prior to rightful ownership. The carrier may function as a substrate to support the one or more items. The carrier may provide a retail merchant means for activating and/or scanning the one or more items, such as a transaction card.

For example, the card carrier may include a barcode on a surface of the card carrier to allow for scanning by a retail merchant. Similarly, the card carrier may facilitate securing a transaction card while still exposing a barcode or portion of the transaction card for reading and/or scanning by the retail merchant. For example, the card carrier may at least partially cover the transaction card yet include a window extending through the card carrier to expose a barcode located along the transaction card. It should also be noted that various configurations—such as sizing of one or more windows, locations of the barcodes, additional information present on the card carrier, etc. —are also possible based on industry needs.

The carrier may include one or more panels. The panels may provide structural support to the carrier. The panels may support and/or house the one or more items. The carrier may include one or more panels, two or more panels, or three or more panels. The carrier may include six or less panels, five or less panels, or four or less panels. Each panel may include a plurality of layers or may be monolithically formed. The one or more panels may be integrally formed with one another to improve manufacturing efficiency and decrease material waste. For example, the one or more panels may be die-cut from a single layer of stock and interconnected via one or more perforations, fold lines, or both. Similarly, the one or more panels may be joined via and adhesive, mechanical fastener, or both.

The carrier may be connected to gift packaging. The carrier may be integrally formed with the gift packaging. That is, the carrier and the gift packaging may be cut or shaped from a shared material. The carrier and the gift packaging may be foldable and/or bendable relative to one another. For example, a fold line may exist between the carrier and the gift packaging to allow for folding of the carrier relative to the gift packaging, or vice versa. It is also envisioned that the gift packaging and the carrier may beneficially be separable to allow for a customer to purchase the one or more items within the packaging and then later place the one or more items into the gift packaging to present to a gift recipient. In doing so, the gift packaging may be free of additional portions of the packaging, such as the card carrier, thereby providing the customer a more aesthetically pleasing gift presentation.

To provide such separable gift packaging, the carrier and the gift packaging may be connected by a perforation. The perforation may function to allow separation between the gift packaging and the carrier. The perforation may provide a customer visual indication as to where the gift packaging and the carrier should be separated. The perforation may also ease separation compared to a connection point between the perforation and the gift packaging free of a perforation. The perforation may extend along one or more edges of the gift packaging, the card carrier, or both. The perforation may at least partially outline a shape of the gift packaging, the card carrier, or both. For example, the packaging may be die-cut from a paperboard and a secondary operation may die cut a perforation along a fold line between the gift packaging and the card carrier to allow for easier separation. Similarly, the perforation may be any desired size and shape. The perforation may extend through a thickness of the gift packaging, the card carrier, or both. The perforation may extend through only a portion of the thickness of the gift packaging (e.g., the perforation is a partial cut). It should also be noted that perforation as described herein may also include scoring in one or more area to allow for easier separation between the gift packaging, the card carrier, additional components, or a combination thereof.

Additionally, components may be connected to the card carrier, the gift packaging or both by additional perforations. For example, the packaging may include a secondary tab connected to the card carrier, the gift packaging, or both. While the tab may be connected using a common perforation connecting the gift packaging and the card carrier, a secondary perforation may also be utilized. Thus, it is envisioned that the packaging may include a plurality of perforations extending in various directions relative to each other. The perforations may interconnect, intersect, be free of contact, or a combination thereof. The perforations may form any desired angles. The perforations may vary in width, length, or both. The perforations may extend to one or more terminal edges of the packaging, such as the card carrier, the gift packaging, or both. Conversely, or additionally, the perforations may be free of contact with one or more terminal edges of the packaging.

The gift packaging as described herein may be any secondary packaging utilized to repackage the gift card for a gift recipient. Therefore, it is envisioned that the gift packaging may be a gift box, giftwrap, envelope, a gift bag, or a combination thereof. Thus, the packaging may beneficially integrate any such gift packaging with a card carrier, thereby providing the customer an efficient manner of packaging the one or more items as a gift.

The gift packaging may include one or more panels similar to, or different from, the one or more panels of the card carrier. The panels of the gift packaging may form an envelope. For example, when the panels are joined a pocket may be formed between the panels. The pocket may be configured or shaped to receive the one or more items. Beneficially, the pocket may be formed to meet any desired dimensions to receive the one or more items. For example, the pocket may be oversized relative to the one or more items or the pocket may have a similar size to that of the one or more items.

The panels of the gift packaging may be joined via one or more adhesives. The adhesive may be disposed on one or more mating surfaces of the panels of the gift packaging so that, when the opposing surfaces abut one another, the adhesive bonds together the opposing surfaces and forms a seal between the panels. The adhesive may be positioned anywhere along the opposing surfaces of the panels. The adhesive may be positioned along one or more edges of the panels, one or more edges of the panels may be free of an adhesive, or both. For example, the adhesive may extend to one or more peripheral edges of the gift packaging while also extending inwardly away from the one or more peripheral edges to at least partially form the pocket of the envelope. The adhesive may be coextensive with one or more edges of the panel. The adhesive may extend beyond one or more edges of the panels. Alternatively, the adhesive may remain within the confines of the panels so that the adhesive does not extend beyond the boundaries of the gift packaging. Similarly, the pocket of the carrier may be free of the adhesive so that the one or more items may be freely removed from the carrier. Alternatively, the pocket may include the adhesive to secure the one or more items within the pocket. The adhesive may be strong enough to maintain a position of the one or more items yet allow for adhesive failure without damaging the one or more items upon removal.

The adhesive may be any desired composition. The adhesive may be polyvinyl acetate (PVA) glue, cyanoacrylate, a pressure sensitive adhesive (PSA), epoxy, polyurethane, other polymers, or a combination thereof.

The packaging may be made from any material. The packaging (e.g., the gift packaging, the card carrier, the tab, or a combination thereof) may be made from paperboard, cardboard, corrugated fiberboard, polyethylene terephthalate (PET), high-density polyethylene (HDPE), polyvinyl chloride (PVC), low-density polyethylene (LDPE), polypropylene (PP), polystyrene (PS), acrylic, nylon, polycarbonate, polylactic acid, or a combination thereof. The packaging may include a surface finish. The packaging may include a finish stamping to indicate a desired product and/or brand. For example, the gift packaging may include one or more decorative images disposed on one or more surfaces to indicate branding, decoration, information, or a combination thereof. Additionally, the packaging may include a protective coating. For example, the packaging may include a UV-resistant and/or moisture-resistant coating to protect the packaging—and thus the one or more items within the packaging—from damaging light and/or moisture.

Turning now to the figures, FIG. 1 illustrates packaging 10 for a transaction card 24. As shown, the packaging 10 is in an open position, whereby gift packaging 14 of the packaging 10 is unfolded from a card carrier 12. The gift packaging 14 may be folded relative to the card carrier 12 along a perforation 36 joining the gift packaging 14 and the card carrier 12 so that, upon folding, a second panel 14B of the gift packaging 14 abuts a first surface 12A of the card carrier 12 (see FIGS. 2A and 2B).

The perforation 36 may be any size, length, shape, spacing, width, or combination thereof. As such, it is envisioned that the perforation 36 may be any design to facilitate connecting and/or bending of the gift packaging 14 relative to the card carrier 12, or vice versa, yet still provides an easy means of separating the gift packaging 14 from the card carrier 12, or vice versa. Thus, beneficially, the gift packaging 14 and the card carrier 12 may be quickly disconnected from each other free of tearing the gift packaging 14 or the card carrier 12. Additionally, the separation along the perforation 36 may also allow for substantially smooth edges for both the gift packaging 14 and the card carrier 12, thereby aesthetically improving the gift packaging 14.

To facilitate display of the packaging 20, the card carrier 12 may include an aperture 20 to hang the packaging 10 from a hook or other type of display rack. Similarly, a tab 22 having an additional aperture 20 may be connected to the envelope 14 by another perforation 36 so that, when the packaging 10 is in a closed state, the aperture 20 of the tab 22 and the aperture 20 of the card carrier 12 align, thereby allowing a hook or hanging mechanism to extend through both apertures 20 to hang the packaging 10. Therefore, the apertures 20 may have a substantially similar or identical shape to ease with proper alignment and/or hanging.

When in a closed state, the packaging 10 may enclose a transaction card 24, such as a gift card or other monetarily loadable card, between the second panel 14B of the gift packaging 14 and the first surface 12A of the card carrier 12. Therefore, the packaging 10 may advantageously hide substantially all or a portion of the transaction card 24 prior to purchase by a customer to prevent tampering or other fraudulent activity. Additionally, the transaction card 24 may be secured to the card carrier 12 to maintain a position of the card carrier during display and handling of the packaging 10. The transaction card 24 may be secured to the card carrier 12A by one or more adhesives, joining materials, mechanical securement features (e.g., slots within the card carrier 12, hook-and-loop fasteners, etc.), other means, or a combination thereof. However, it should be noted that while the transaction card 24 may be secured to the card carrier 12A to prevent accidental movement of the transaction card 24, the transaction card 24 may still be easily separated from the card carrier 12A without damage and/or distortion to the transaction card 24.

The packaging 10 may beneficially provide a customer integrated gift packaging 14 so that, upon purchase of the transaction card 24, the customer may remove the transaction card 24 from the card carrier 12 and insert the transaction card 24 into the gift packaging 14. As further discussed below, while the gift packaging 14 is integrated with the card carrier 12, the gift packaging 14 may be easily separated from both the card carrier 12 and the tab 22.

Such separation is facilitated by the perforations 36 connecting the gift packaging 14 to the card carrier 12 and the tab 22. As illustrated, the perforation 36 connecting the gift packaging 14 to the tab 22 may extend substantially transverse to the perforation 36 connecting the gift packaging 14 to the card carrier 12. Furthermore, the perforation 36 connecting the gift packaging 14 to the tab 22 may extend directly into the perforation connecting the gift packaging 14 to the card carrier 12. Therefore, the packaging 10 may allow for complete disconnection of each component—the tab 22, the gift packaging 14, and the card carrier—from each other. Similarly, the perforation 36 extending between the card carrier 12 and the gift packaging 14 may also extend beyond a length of the gift packaging 14 to connect the tab 22 to the card carrier 12. However, it is also envisioned that the tab may be free of connection to the carrier 12 to even further ease separation of the tab 22.

Additionally, it should be noted that while perforations 36 are shown substantially perpendicular to each other, any angle between the perforations 36 may be possible. For example, the perforation 36 between the tab 22 and the gift packaging 14 may form an angle with the perforation 36 between the gift packaging 14 and the card carrier 12 of about 35 degrees or more, about 60 degrees or more, or about 85 degrees or more. The perforation 36 between the tab 22 and the gift packaging 14 may form an angle with the perforation 36 between the gift packaging 14 and the card carrier 12 of about 155 degrees or less, about 130 degrees or less, or about 105 degrees or less. Similarly, any number of perforations may be present to ensure proper separation of the gift packaging 14 from the tab 22, the card carrier 12, or both. For example, the packaging 10 may include about one or more perforations 36, about two or more perforations 36, or about three or more perforations 36. The packaging 10 may include about six or less perforations 36, about five or less perforations 36, or about four or less perforations 36.

Figure 2A:
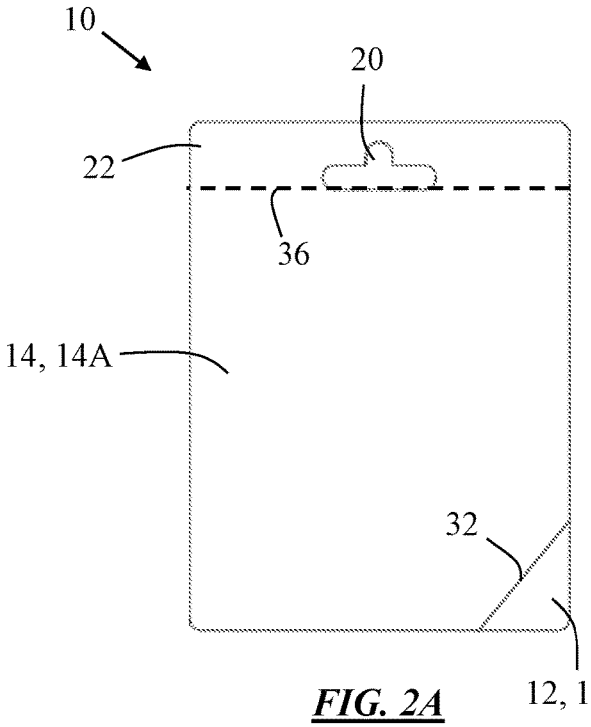
FIG. 2A is a front view of packaging for a transaction card.
Figure 2B:
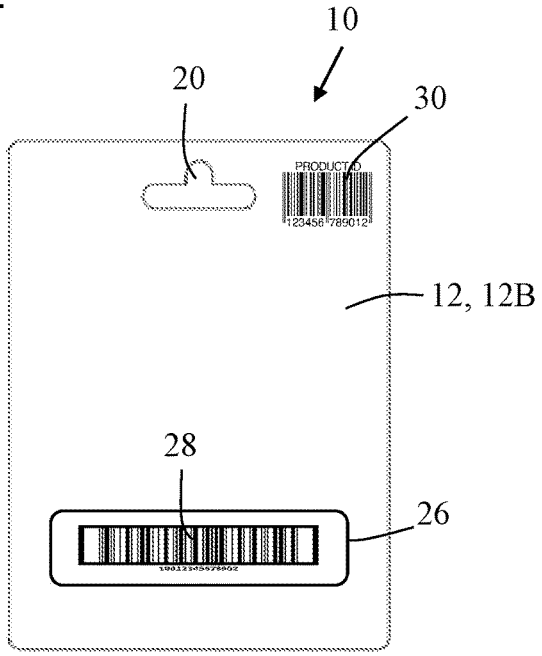
FIG. 2B is a rear view of packaging for a transaction card.

The packaging 10 may further include an opening feature 32 to allow a customer, a retail merchant, or both to easily open the packaging 10 when in a closed state (see FIGS. 2A and 2B). The opening feature 32 may be located along the gift packaging 14, the card carrier 12, or both. As shown in FIG. 1, the opening feature 32 may be a truncated or cut corner of the gift packaging 14. As a result, a customer or retail merchant may have an indicated location that allows for easier unfolding of the gift packaging 14 relative to the card carrier 12, or vice versa. Additionally, the opening feature 32 may also provide a visual indicator to a customer that the packaging can be open to reveal the transaction card 24 secured within. It is also envisioned that the opening feature may be a mechanical feature, such as a handle, projection, tab, or a combination thereof.

Similarly, the gift packaging 14 may also include a notch 34 along a peripheral edge of the gift packaging 14. The notch 34 may provide a visual indication to a customer that the transaction card 24 may be inserted into a cavity of the gift packaging 14 (see FIG. 5). Insertion of the transaction card 24 may be completed prior to separation of the gift packaging 14 from the card carrier 12, the tab 22, or both, after separation of the gift packaging 14 from the card carrier 12, the tab 22, or both, or both before and after separation.

FIGS. 2A and 2B illustrate a front and rear view of the packaging 10 of FIG. 1 in a closed position, respectively. As discussed above, to place the packaging 10 in the closed position, the gift packaging 14 may be folded onto the card carrier 12 so that a second panel 14A of the gift packaging 14 abuts a first surface 12A of the card carrier 12. In the closed position, the packaging 10 may also be secured to ensure opening is not done unintentionally until a customer purchased the transaction card 24. For example, an adhesive, piece of tape, additional perforation, or a combination thereof may exist to secure a portion of an edge of the gift packaging 14 to an edge of the card carrier 12. The edges joined in the closed state to allow for unfolding (i.e., opening) of the packaging 10 may be different edges than the abutting edges between the gift packaging 14 and the card carrier 12 that allow for unfolding. Conversely, no additional joining of the gift packaging 14 to the card carrier 12 may exist so that the gift packaging 14 may be freely unfolded and/or folded relative to the card carrier 12, or vice versa.

As shown in FIG. 2A, a first panel 14A of the gift packaging 14 may be visible from the front. It is envisioned that the front view may be the perspective seen by customers when the packaging 10 is on display in a store. Thus, a user may select the packaging 10 off of a display rack and open the packaging 10 by unfolding the gift packaging 14 relative to the card carrier 12 via the opening feature 32.

After a customer has selected the desired packaging 10, a retail merchant may utilize the rear side of the packaging 10 to activate and/or load the transaction card 24. As shown in FIG. 2B, the rear view of the packaging 10 illustrates a second surface 12B of the card carrier 12. The second surface 12B of the card carrier 12 may include a barcode 30 that may be scanned by the retail merchant. Similarly, the card carrier 12 may include a window 26 to expose a barcode 28 located on the transaction card 24. Thus, a retail merchant may beneficially be able to scan the barcode 28 on the transaction card 24 without opening the packaging 10. Similarly, the window 26 may provide a customer visual indication that the transaction card 24 is present within the packaging 10 without opening the packaging 10. Thus, the window 26 may advantageously provide an additional security means to protect from fraudulent activity.

Figure 3:
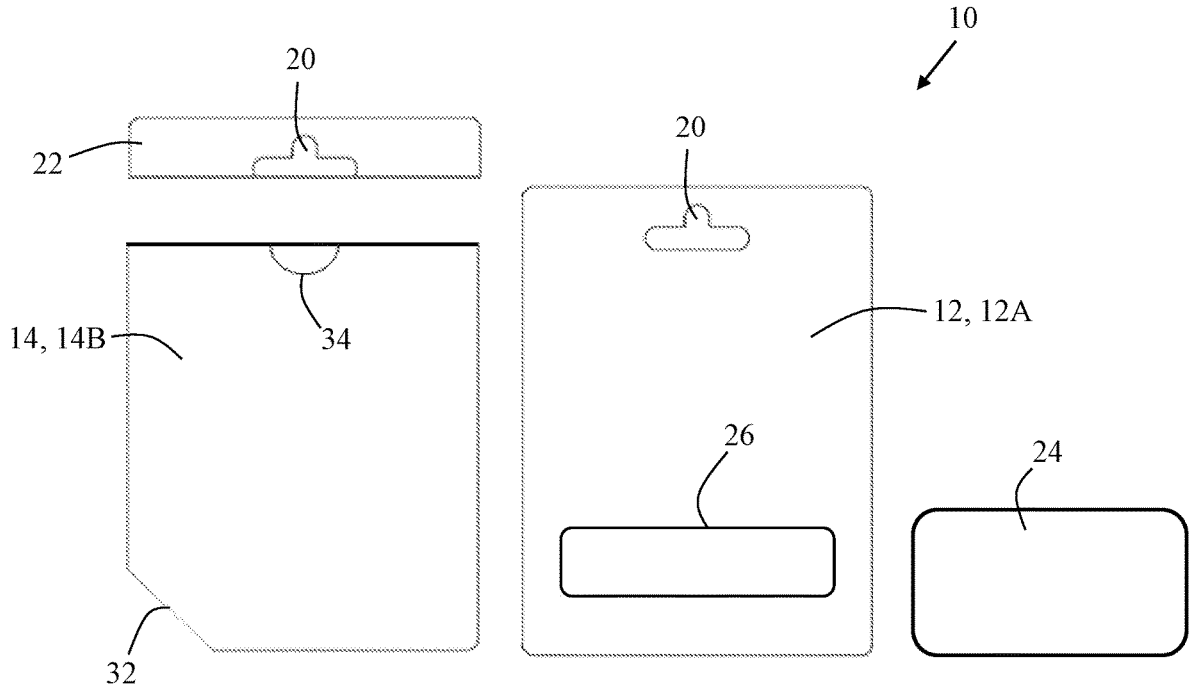
FIG. 3 is an exploded view of packaging for a transaction card.

FIG. 3 illustrates an exploded view of the packaging 10 in accordance with the present teachings. It is envisioned that the packaging 10 may provide a high degree of disconnection and/or separation so that a customer may purchase the transaction 24, remove the transaction card 24 from the packaging 10, and insert the transaction card 24 into the gift packaging 14 to present to a gift recipient (see FIG. 5).

To prepare the transaction card 24 as a gift, a customer must first select the desired packaging 10 and transaction 24 for purchase. The packaging 10 may be selected in a closed state, given to a retail merchant, and activated by the retail merchant as described above using the window 26 in the card carrier to scan the barcode of the transaction card 24. Once purchasing is complete, the customer may open the packaging 10 (see FIG. 1) via the opening feature 32 to reveal the transaction card 24 secured to the first surface 12A of the card carrier 12. The transaction card 24 may then be separated from the carrier 12.

To prepare the gift packaging 14, the gift packaging 14 may be separated from the card carrier 12 and the tab 22 along the perforations described above (see FIG. 1). Separation may be completed in a number of ways. For example, if the packaging 10 is comprised of substantially flexible materials (e.g., paperboard, cardboard, etc.), the gift packaging 14 may be torn along the perforations to separate the gift packaging 14 from the tab 22, the card carrier 12, or both. If the packaging 10 is comprised of a more rigid material (e.g., plastic), the gift packaging 14 may be "snapped" by bending the gift packaging 14 along the perforation in a specific direction to disconnect the gift packaging 14 from the tab 22, the card carrier 12, or both.

As such, it may be gleaned from the present teachings that the packaging 10 may be highly customizable to meet different industry requirements and/or demands. For example, the tab 22 may remain connected to the gift packaging 14 after separation from the card carrier 12 to decrease the number of disconnections needed when preparing the transaction card 24 as a gift. That is, the tab 22 may be connected to the gift packaging 14 free of any perforation. Similarly, the packaging 10 may be free of a tab 22 altogether so that the gift packaging 14 may be even more quickly separated from the card carrier 12. Thus, the packaging 10 may be displayed in a retail establishment by hanging the packaging 10 solely by the aperture 20 in the card carrier 12.

After separation of the gift packaging 14, the transaction card 24 may be inserted into a cavity formed between the first panel of the gift packaging 14 (see FIG. 2A) and the opposing second panel 14B of the gift packaging 14. Such a cavity may be indicated by a notch 34 formed along an edge of the gift packaging 14 after separation. The notch 34 may be positioned along an opening that allows a customer to access the cavity of the gift packaging 14 by partially separating the first panel and the second panel 14B of the gift packaging 14 to insert the transaction card 24.

While the gift packaging 14 described above may contain a cavity to receive the transaction card 24, other gift packaging 14 is also envisioned for the packaging 10. For example, the packaging 10 may include a gift box, giftwrap, or other gift packaging that is separable from the card carrier 12. Thus, the packaging 10 may be customizable to provide customers with various options for gift packaging. For example, an unfolded gift box may be connected to the card carrier 12. The gift box may be separated from the card carrier 12 and then folded into a fully assembled gift box. After assembly, the transaction card 24 may be inserted into the gift box for presentation to the gift recipient.

Figure 4:
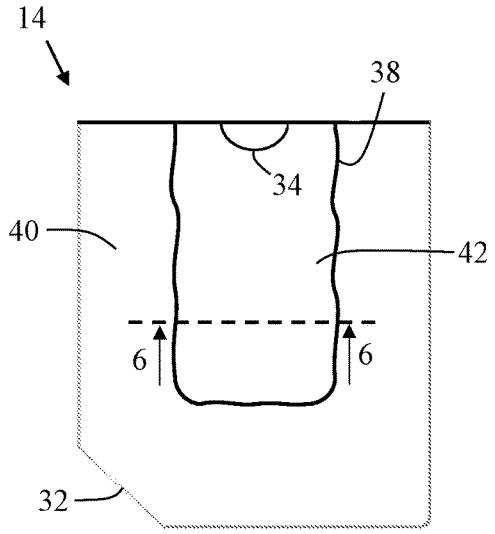
FIG. 4 is a transparent view of an envelope of the packaging for a transaction card.

FIG. 4 illustrates a detailed, partially transparent view of the gift packaging 14 described above. As shown, the gift packaging 14 is an envelope 40 formed by two adjacent panels being secured to each via an adhesive 38. The panels may be joined by the adhesive 38 to form a pocket 42 therein. The pocket 42 may be and size and shape as dictated by the adhesive 38. As shown in FIG. 4, the adhesive 38 may join the panels of the envelope 40 and form the walls of the pocket 42. The adhesive may beneficially be free of full encapsulating the pocket 42 to provide an opening for the transaction card 24 to be inserted into the pocket 42.

The opening may be located along an edge of the envelope 40 and may be indicated by a notch 34. The notch 34 may be positioned along the edge of the envelope 40 that forms the opening to provide a customer a visual indication as to where the opening is located. The notch 34 may be any size and/or shape. The notch 34 may also be located in one or both panels of the envelope.

The opening of the pocket 42 may be located along any edge of the envelope 40. As shown in FIG. 4, the opening may be positioned along a short edge of the envelope 40. That is, an edge of the envelope 40 having a length less a length of another edge of the envelope 40. However, the opening may be located along any edge of the envelope 40. As such, the envelope may be customizable to be any desired shape.

The envelope 40 may also beneficially be designed as oversized packaging. That is, the envelope 40 may have overall dimensions (e.g., length, width, thickness, area, etc.) greater than the overall dimensions of the transaction card 24. Therefore, the envelope 40 may provide a customer a more aesthetically pleasing gift packaging 14 to present to a gift recipient when compared to a conventional sleeve for a transaction card 24. Similarly, due to the oversized dimensions of the envelope 40, an opening feature 32 may be located along the envelope without encroaching on the pocket 42 configured to house the transaction card 24.

To ensure the transaction card 24 is properly secured within the pocket 42 of the envelope 40, the adhesive 38 may be disposed to ensure dimensions of the pocket 42 substantially coincide with dimensions of the transaction card 24. As shown in FIG. 4, the pocket 42 is dimensionally smaller than the envelope 40 to securely maintain a position of the transaction card 24 within the pocket 42. When inserted, the transaction card 24 may abut one or more walls formed by the adhesive 38 to snugly maintain a position of the transaction card 24. For example, when the transaction card 24 is fully inserted into the pocket 42, an edge of the transaction card 24 may be substantially flush with an edge of the envelope 40. Furthermore, a portion of the transaction card 24 may be exposed by the notch 34 to provide a gift recipient a visual indication of the transaction card 24. Similarly, the notch 34 may also provide the gift recipient a means of easily removing the transaction card 24 from the envelope 40.

The adhesive 38 may be disposed in any pattern to join the panels of the envelope 40, to form the pocket 42, or both. For example, the adhesive 38 may be free of touching one or more terminal edges of the envelope, may extend to one or more terminal edges of the envelope, or both. The adhesive 38 may form one or more walls of the pocket 42. The adhesive 38 may be located in substantially all areas (i.e., along substantially an entire surface of the adjoining panels) outside of the pocket 42 formed therein. The adhesive 38 may be disposed to ensure that the adhesive 38 is not easily seen after joining the panels of the envelope 40.

Figure 5:
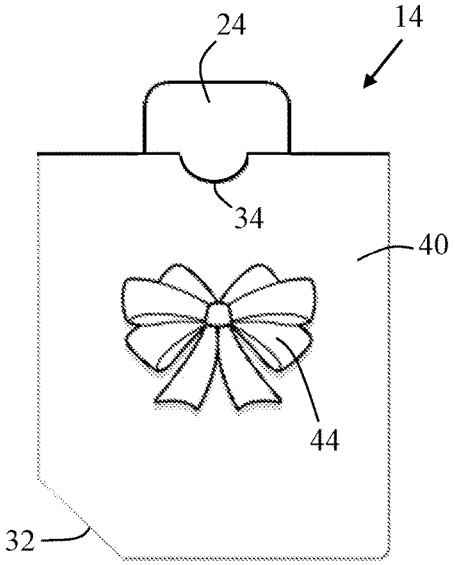
FIG. 5 is a perspective view of an envelope of the packaging for a transaction card.

FIG. 5 illustrates a perspective view of gift packaging 14 in accordance with the present teachings. As shown, the gift packaging 14 is an envelope that receives the transaction card 24. The transaction card is inserted into a cavity via an opening along a short edge of the envelope—that is, a portion of the short edge free of adhesive. While FIG. 5 illustrates the transaction card 24 being inserted so that a short edge of the transaction card 24 is substantially parallel to the short edge of the envelope 40, is substantially flush with the short edge of the envelope 40, or both, other configurations are possible. For example, the transaction card 24 may inserted along the short edge of the envelope through the opening so that a long edge of the transaction card 24 is substantially parallel to the short edge of the envelope 40, is substantially flush with the short edge of the envelope 40, or both. Similarly, the pocket of the envelope 40 may include an opening along one or more long edges of the envelope (e.g., an edge of the envelope 40 substantially perpendicular to the short edge), and the transaction card 24 may be inserted through the opening so that a long or short edge of the transaction card 24 is substantially parallel and/or flush with the long edge of the envelope 40. As such, it may also be gleaned that, depending on the location of the opening of the pocket, the notch 34 and/or the opening feature 32 may be positioned along any edge of the envelope 40. It should also be noted that the envelope 40 may be free of a notch 34, an opening feature 32, or both. For example, the opening feature 32 may be located on the card carrier instead of the envelope 40.

Additionally, the envelope 40 may beneficially include one or more decorative images 44 located along the first panel or the second panel of the envelope 40. Thus, the envelope 40 may provide an even greater degree of customization for gift-giving.

Figure 6:
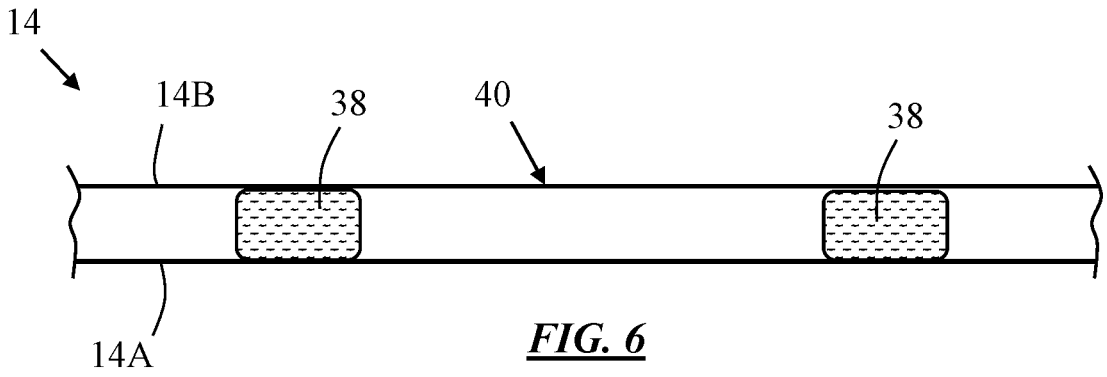
FIG. 6 is cross-section 6-6 of the envelope of FIG. 4.

FIG. 6 illustrates cross-section 6-6 of the envelope 40 shown in FIG. 4. A first panel 14A and an opposing second panel 14B of the gift packaging 14 may be joined by an adhesive 38 to form the envelope 40. The adhesive 38 may be disposed between the panels 14A, 14B as one or more beads to form a pocket 42 therebetween. As illustrated, the adhesive 38 may form one or more walls of the pocket 42, whereby the pocket 42 may be a portion between the panels 14A, 14B free of adhesive 38.

ELEMENT LIST

10 Packaging
12 Card Carrier
12A First Surface of the Card Carrier
12B Second Surface of the Card Carrier
14 Gift Packaging
14A First Panel of the Gift Packaging
14B Second Panel of the Gift Packaging
20 Aperture
22 Tab
24 Transaction Card
26 Window
28 Transaction Card Barcode
30 Card Carrier Barcode
32 Opening Feature
34 Notch
36 Perforation
38 Adhesive
40 Envelope
42 Pocket
44 Decorative Image Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. Packaging for a transaction card, comprising:

(1) a card carrier having the transaction card secured to a first surface of the card carrier; and (2) gift packaging integrally formed with and separable from the card carrier, the gift packaging having a first panel joined to an opposing second panel by an adhesive, whereby a pocket free of the adhesive is formed between the first panel and the second panel, and the adhesive forms a shape of the pocket to receive the transaction card; and wherein, in a closed state, the gift packaging is folded onto the card carrier so that the second panel of the gift packaging substantially abuts the first surface of the card carrier and sandwiches the transaction card between the first surface of the card carrier and the second panel of the gift packaging.

2. The packaging of claim 1, wherein a long edge of the card carrier and a long edge of the gift packaging are integrally connected to form a fold line.

3. The packaging of claim 2, wherein the fold line includes a first perforation extending along an entire length of the fold line, an entire length of the long edge of the carrier, and an entire length of the long edge of the gift packaging.

4. The packaging of claim 3, further comprising a tab integrally formed and separable from the gift packaging, the card carrier, or both.

5. The packaging of claim 4, wherein the tab is connected to the card carrier by the first perforation.

6. The packaging of claim 5, wherein the tab is connected to the gift packaging by a second perforation extending along a short edge of the gift packaging.

7. The packaging of claim 6, wherein the second perforation extends substantially perpendicular to the first perforation.

8. The packaging of claim 7, wherein the tab and the card carrier each include an aperture, and the apertures of the tab and the card carrier substantially align when the packaging is in the closed state.

9. The packaging of claim 5, wherein the gift packaging is an envelope formed by joining the first panel and the opposing second panel.

10. The packaging of claim 9, wherein the envelope is dimensionally oversized relative to the transaction card.

11. The packaging of claim 9, wherein the envelope includes one or more decorative images located on the first panel, the opposing second panel, or both.

12. The packaging of claim 3, wherein in the closed state, the first panel of the gift packaging is visible from a front view and the card carrier is substantially obstructed from view.

13. The packaging of claim 12, wherein in the closed state, an opposing second surface of the card carrier is visible from a rear view while the gift packaging is obstructed from view.

14. The packaging of claim 13, wherein the second surface of the card carrier includes a barcode and a window extending through a thickness of the card carrier.

15. The packaging of claim 14, wherein a barcode located on the transaction card is visible through the window of the card carrier.

16. The packaging of claim 1, wherein the pocket includes an opening along the short edge of the gift packaging located along a second perforation.

17. The packaging of claim 16, wherein the pocket further includes a notch along the opening located on the first panel, the second panel, or both panels of the gift packaging.

18. The packaging of claim 16, wherein when the transaction card is inserted into the pocket, the transaction card abuts the adhesive, and an edge of the transaction card is substantially flush with the short edge of the packaging.

* * * * *